US011668542B2

(12) United States Patent
Walthert

(10) Patent No.: US 11,668,542 B2
(45) **Date of Patent: *Jun. 6, 2023**

(54) AIMABLE DEVICE STOCK WITH MULTI-FUNCTION FORESTOCK

(71) Applicant: CROSMAN CORPORATION, Bloomfield, NY (US)

(72) Inventor: Hans J. Walthert, Rush, NY (US)

(73) Assignee: CROSMAN CORPORATION, Bloomfield, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/521,351

(22) Filed: Nov. 8, 2021

(65) Prior Publication Data

US 2022/0136796 A1 May 5, 2022

Related U.S. Application Data

(63) Continuation of application No. 16/871,950, filed on May 11, 2020, now Pat. No. 11,168,955, which is a continuation of application No. 16/393,581, filed on Apr. 24, 2019, now Pat. No. 10,794,658.

(60) Provisional application No. 62/661,633, filed on Apr. 24, 2018.

(51) Int. Cl.

| | |
|---|---|
| ***F41B 5/12*** | (2006.01) |
| ***F41B 5/14*** | (2006.01) |
| *F41C 23/16* | (2006.01) |
| *F41A 23/08* | (2006.01) |

(52) U.S. Cl.

CPC ..... *F41B 5/12* (2013.01); *F41B 5/1453* (2013.01); *F41A 23/08* (2013.01); *F41C 23/16* (2013.01)

(58) Field of Classification Search

CPC .. F41B 5/12; F41B 5/14; F41B 5/1453; F41A 23/08

See application file for complete search history.

(56) References Cited

U.S. PATENT DOCUMENTS

| | | | |
|---|---|---|---|
| 8,161,956 | B2 | 4/2012 | Bednar |
| 8,904,693 | B1 | 12/2014 | Beltz |
| 9,285,075 | B2 | 3/2016 | Moody et al. |

(Continued)

OTHER PUBLICATIONS

Kel-Tec CNC Industries, Inc., SU-16 Rifle, Safety, Instruction, and Parts Manual; Rev:0605; 16 pages.

(Continued)

*Primary Examiner* — John A Ricci
(74) *Attorney, Agent, or Firm* — Foley & Lardner LLP

(57) ABSTRACT

Stocks for aimable devices are provided. In one aspect, stock has a body mechanically associated with the aimable device and movable to determine an aiming axis of the aimable device, a shoulder mount positioned proximate to one end of the body, a firing grip positioned apart from the shoulder mount along a length of the body; a support leg having a mounting end pivotably mounted to the body between the firing grip and an end of the body opposite from the shoulder mount and having a foot end movable between a first range of positions and a second range of positions and a receiver located between the mounting of the support leg to the body and the firing grip and adapted to releasably hold the support leg in the first range of positions wherein the at least one support leg provides a grippable forestock.

20 Claims, 12 Drawing Sheets

(56) References Cited

U.S. PATENT DOCUMENTS

| | | | | |
|---|---|---|---|---|
| 9,310,153 | B2 | 4/2016 | Nettleton et al. | |
| 9,982,960 | B2 | 5/2018 | Trpkovski | |
| 10,794,658 | B2 | 10/2020 | Walthert | |
| 11,168,955 | B2 * | 11/2021 | Walthert | F41B 5/123 |
| 2012/0186126 | A1 | 7/2012 | Bartak | |
| 2014/0190059 | A1 | 7/2014 | Ballard | |
| 2015/0198409 | A1 | 7/2015 | DeSomma et al. | |
| 2019/0323791 | A1 | 10/2019 | Walthert | |
| 2020/0340773 | A1 | 10/2020 | Walthert | |

OTHER PUBLICATIONS

Office Action for U.S. Appl. No. 16/871,950, dated Feb. 3, 2021, Walthert, "Aimable Device Stock With Multi-Function Forestock", 6 pages.

* cited by examiner

AIMABLE DEVICE STOCK WITH MULTI-FUNCTION FORESTOCK

CROSS-REFERENCE TO RELATED APPLICATIONS

This Application is a continuation of and claims priority to U.S. patent application Ser. No. 16/871,950, filed May 11, 2020, now U.S. Pat. No. 11,168,955, issued Nov. 9, 2021, which is a continuation of and claims priority to U.S. patent application Ser. No. 16/393,581, filed Apr. 24, 2019, now U.S. Pat. No. 10,794,658, issued Oct. 6, 2020, which claims priority to U.S. Provisional Patent Application No. 62/661,633, filed Apr. 24, 2018, which are incorporated herein by reference.

FIELD OF THE INVENTION

The present disclosure is directed to bipods for use with aimable devices such as firearms, crossbows, and other devices.

BACKGROUND OF THE INVENTION

Bipods are conventionally used with aimable devices such as crossbows, long arms such as firearm rifles and crossbows. Conventionally bipods are mounted to a stock of a rifle at mounting hard points such as mounting holes, posts or studs provided or formed in or on the bodies of weapon systems. Alternatively, bipdods are known that are designed to be mounted to rails such as the Picatinny rail. One example of this is U.S. Pat. No. 9,993,225 which discloses a bipod with a quick connect feature for a standard rails. While commercially useful such a product presupposes the presence of such a rail on the aimable device. Such rails, of course, add cost and expense. Similarly, it is known to provide bipods that are integrated in some fashion with the firearm such as by being integrated with a mounting system such as is done in bipods sold by BLK LBL Bipod and such as are provided in toy foam dart guns.

SUMMARY OF THE INVENTION

Stocks for aimable devices are provided. In one aspect, stock has a body mechanically associated with the aimable device and movable to determine an aiming axis of the aimable device, a shoulder mount positioned proximate to one end of the body, a firing grip positioned apart from the shoulder mount along a length of the body; a support leg having a mounting end pivotably mounted to the body between the firing grip and an end of the body opposite from the shoulder mount and having a foot end movable between a first range of positions and a second range of positions and a receiver located between the mounting of the support leg to the body and the firing grip and adapted to releasably hold the support leg in the first range of positions wherein the support leg provides a grippable forestock.

DESCRIPTION OF THE INVENTION

Figure 1:
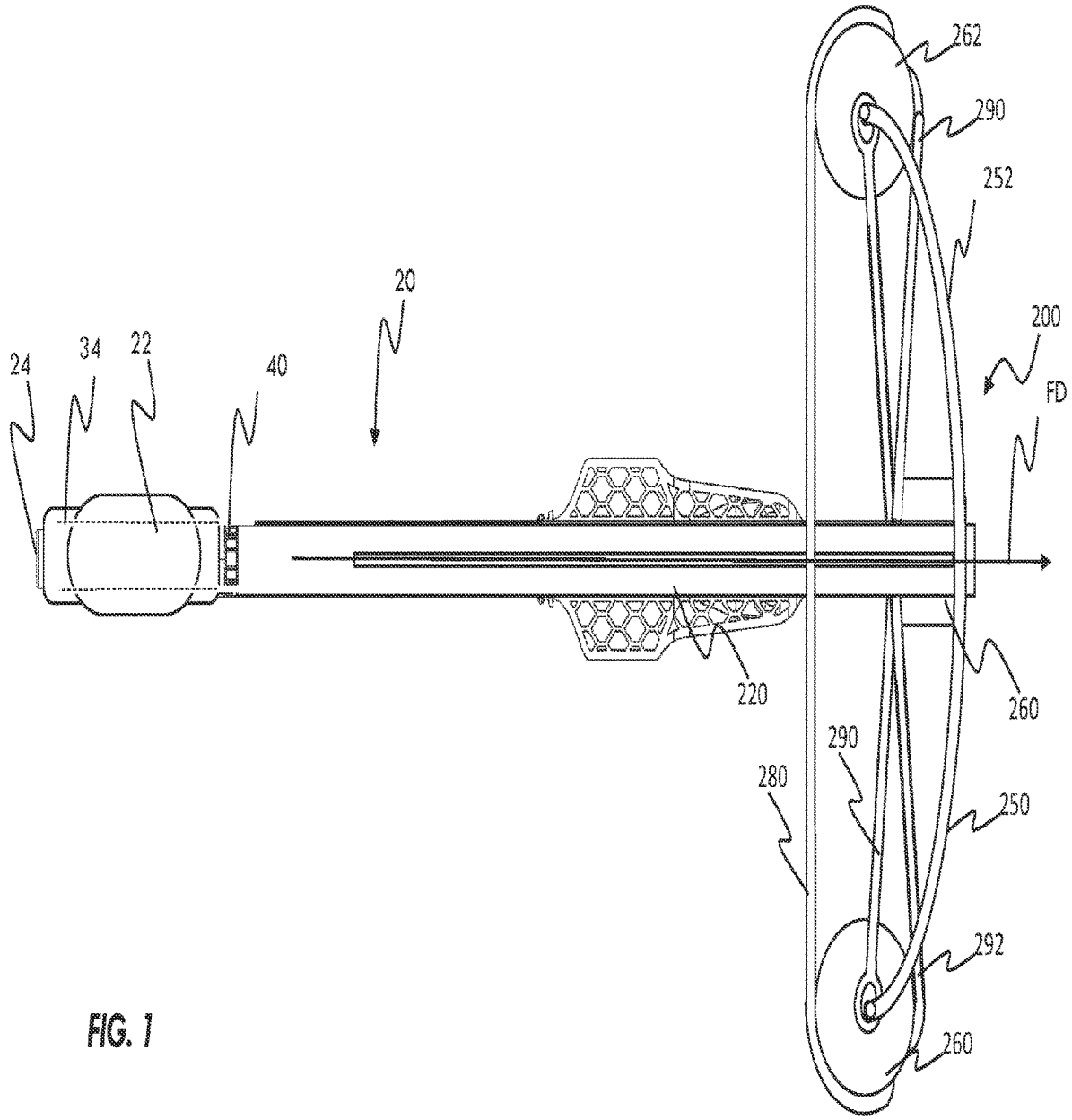
FIG. 1 shows a top view of a stock for an aimable device and a top schematic view of one possible aimable device joined to the stock.
Figure 2:
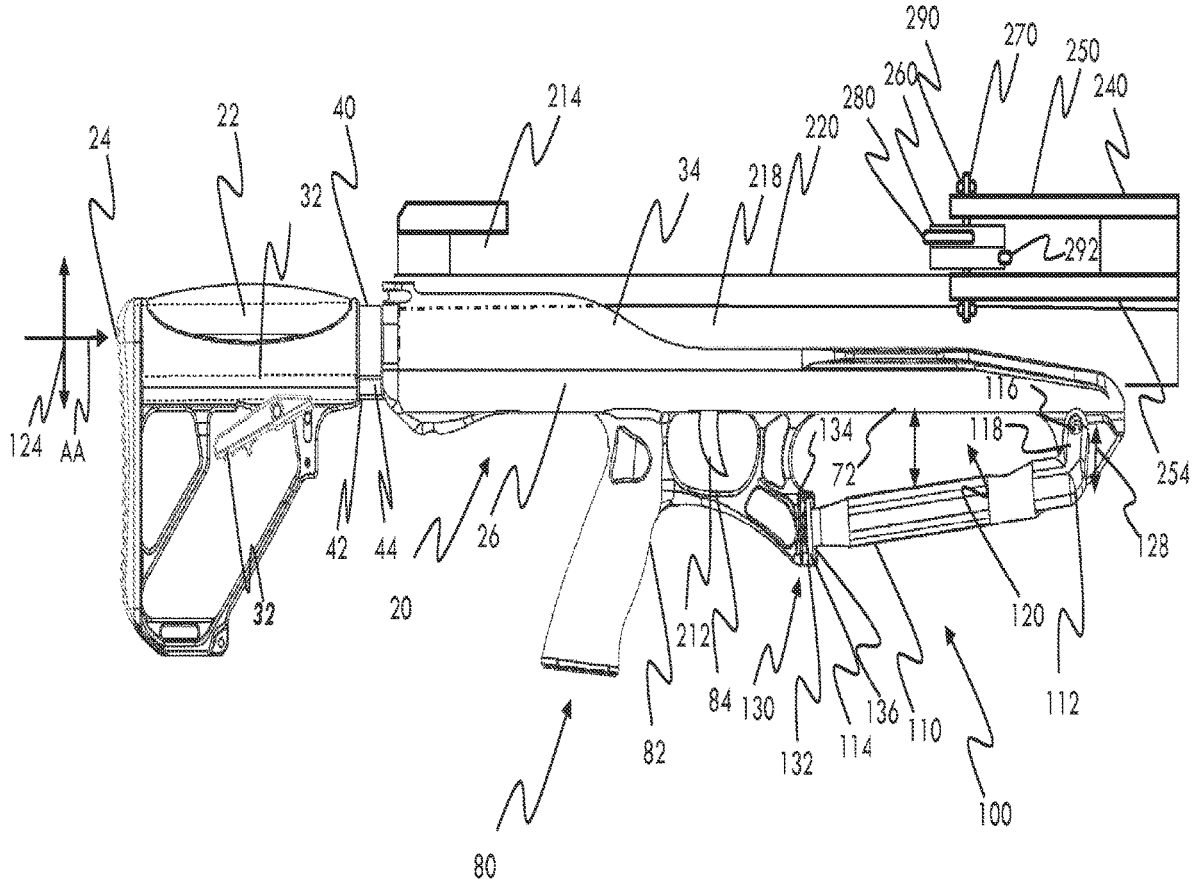
FIG. 2 shows a right side view of the embodiment of the stock of FIG. 1 and a right side schematic view of the aimable device of FIG. 1.
Figure 3:
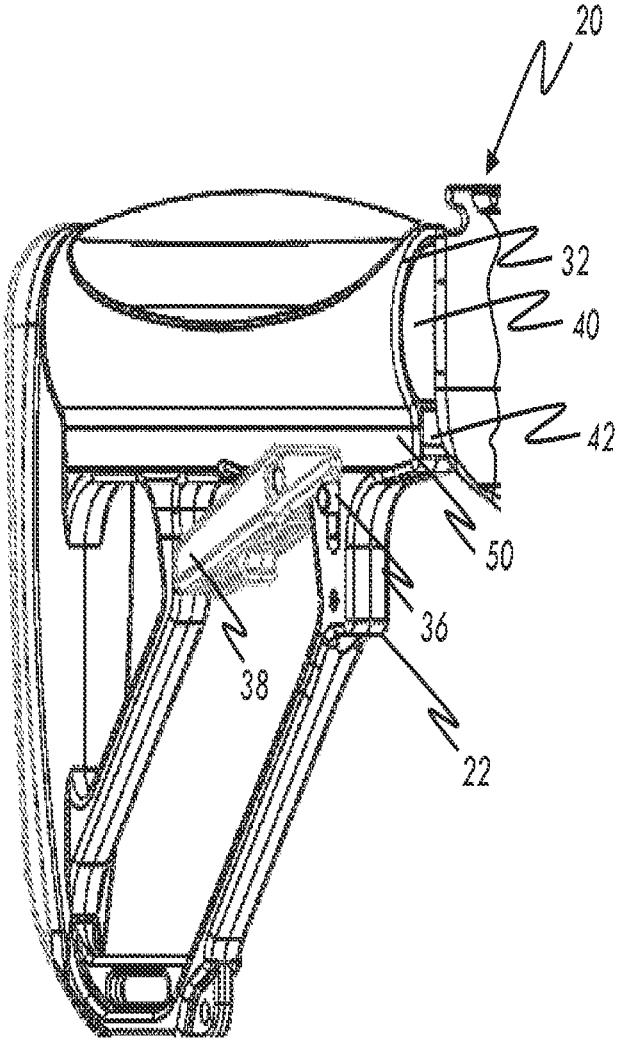
FIG. 3 shows a front right side elevation cut away view of a portion of the stock and shoulder mount of FIGS. 1 and 2.
Figure 4:
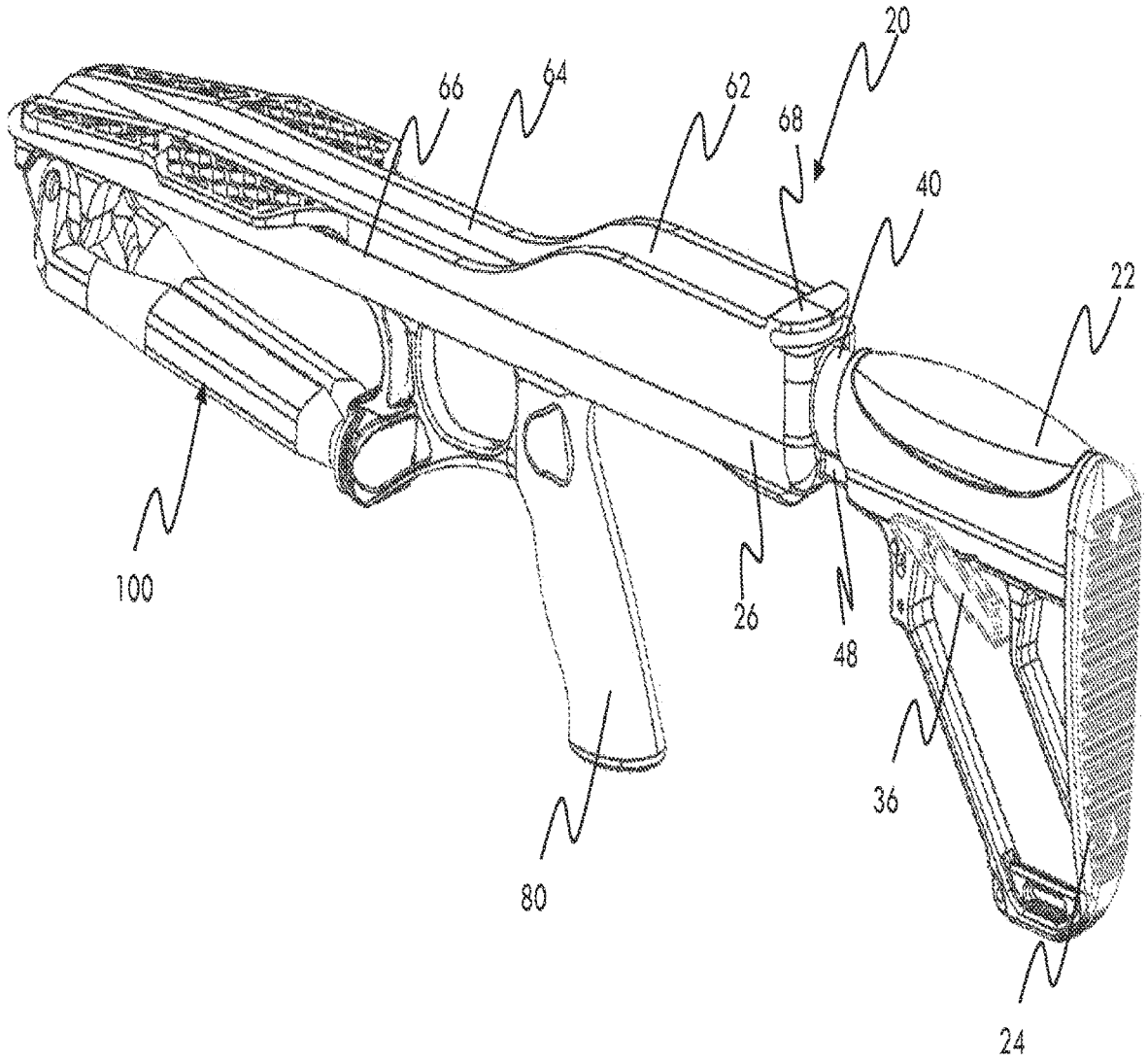
FIG. 4 shows a left back, top isometric view of the embodiment of FIG. 1.
Figure 5:
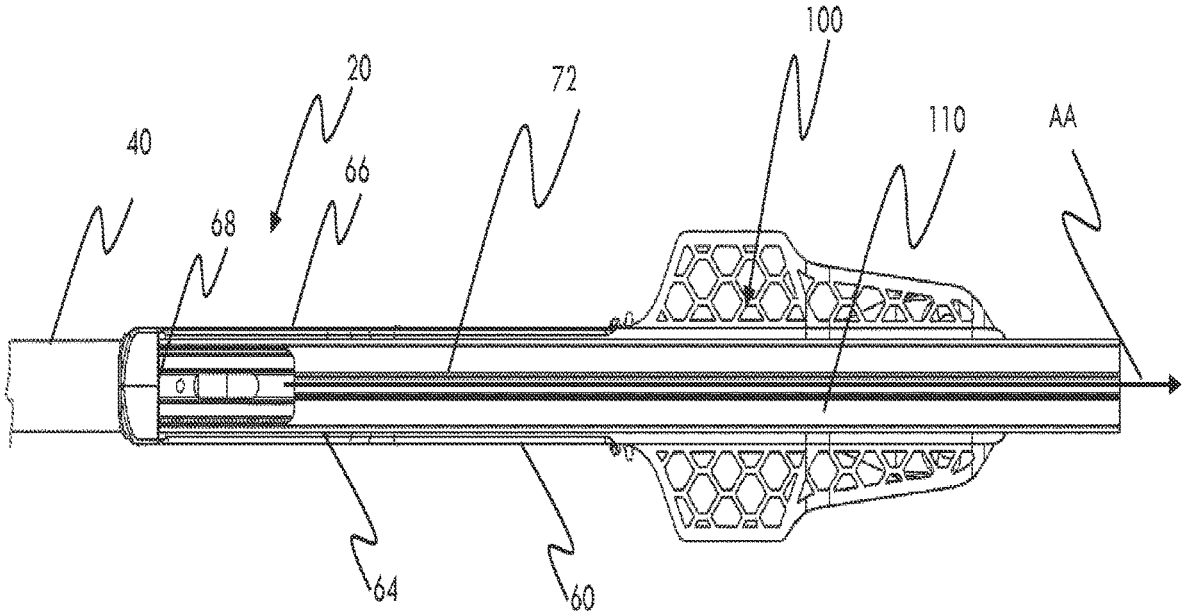
FIG. 5 shows a top view of the embodiment of FIG. 1.

FIG. 1 shows a top view, and FIG. 2 shows a right side view of a stock 20 for an aimable device 200. FIG. 3 shows a front right side elevation cut away view of a portion of stock 20 and shoulder mount 22 of FIGS. 1 and 2 while FIG. 4 shows a left, back, top isometric view of stock 20 of FIG. 1 and aimable device 200 and FIG. 5 shows a top view of stock 20 with aimable device 200 removed. Here aimable device 200 has a firing system 210 with a trigger 212 and a string capture and fire control system 214 which may for example by joined by a frame 216.

In embodiments, stock 20 can have a shoulder mount 22 with a shoulder confronting portion 24 shaped to allow a shoulder of a user to be butted up against shoulder confronting portion 24 to help brace or stabilize stock 20 and associated aimable device 200 during aiming and firing of aimable device 200. In embodiments, shoulder mount 22 can be integrally formed as a part of a body 26 of stock 20. In other embodiments, shoulder mount 22 and body 26 can comprise separate or separable structures that can be positioned together in a manner that limits relative movement between shoulder mount 22 and body 26 so as to provide the aforementioned bracing or stabilization.

In embodiments, shoulder mount 22 and body 26 can be configured so that shoulder mount 22 and body 26 can be held at any of a plurality of positions relative to each other. FIG. 3 shows a front right side elevation cut away view of a portion of stock 20 and shoulder mount 22 of FIGS. 1 and 2 while FIG. 4 shows a left back, top isometric view of the stock 20 of FIG. 1 and aimable device 200 and FIG. 5 shows a top view of stock 20 with aimable device 200 removed. As is shown in FIGS. 1-4, shoulder mount 22 is defined with an interior pathway 30 extending from an opening 32 along a pathway length to an end 34. Pathway 30 and opening 32 are shaped to slidably receive buffer tube 40 and the pathway length is defined so that some or all of a length of a buffer tube 40 can be slidably inserted into pathway 30.

In embodiments, shoulder mount 22 can have a latch 36 that has a surface (not shown) such as a pawl or pin shaped to engage a positioning surface 42 of a ridge area 44. Positioning surface 42 can have surface features such as, for example and without limitation, a ratchet, hole, or detent to hold buffer tube 40 at any one of a plurality of different extents of insertion relative to shoulder mount 22. In embodiments, positioning surface 42 of ridge area 44 may be notched with shoulder mount 22 providing a latch 36 or other features that can selectively interact with the notches to hold stock 20 at a preferred distance from trigger 212. Such embodiments allow a user to adjust a distance between shoulder confronting portion 24 of shoulder mount 22 and trigger 214 within a range of distances. This can be used for example to allow individualized settings for users or to shorten the overall length of stock 20 during transportation.

In embodiments, ridge area 44 can also provide surfaces 46 and 48 that cause buffer tube 40 to have a non-circular cross-section along a length of buffer tube 40 where present. Similarly interior pathway 30 and opening 32 are shaped with a shoulder portions 50 and 52 within which a length of ridge area 44 can be received. In the event that forces are applied that urge shoulder mount 22 to rotate about buffer tube 40, one of shoulder 50 and shoulder 52 will be blocked by a respective one of side surface 46 and side surface 48 to prevent rotation relative to buffer tube 40.

In FIGS. 1, 2 and 4, aimable device 200 includes a barrel 220 that extends between frame 216 and a bow 220. Bow 220 has a riser a 240 that links barrel 220 to at least a first limb 250 and a second limb 252. Optionally crossbow type aimed device 200 may have additional limbs such as a third limb 254 and fourth limb 256. First limb 250 and third limb 254 are joined at their respective first ends end to and extend from riser 240 on the right side of crossbow type aimable device 200 in a generally parallel fashion toward their respective second ends. Similarly in the example of FIGS. 1, 2, and 4, second limb 252 and fourth limb 256 are joined at a first end to and extend from riser 240 on the left side of crossbow type aimed device 200 in a generally parallel fashion toward respective second ends thereof.

As is shown in FIGS. 1 and 2, a right side cam 260 is positioned between first limb 250 and third limb 254 proximate the second ends of first limb 250 and third limb 254 by a rights side pin 270 or other structure assembled or otherwise provided between first limb 250 and third limb 254 and about which right side cam 260 can pivot. As is shown in FIGS. 1 and 3, a left side cam 262 is positioned between second limb 252 and fourth limb 256 proximate the second ends of second limb 252 and fourth limb 256 by a left side pin 272 or other structure assembled or provided between second limb 252 and fourth limb 256 and about which left side cam 192 can pivot. Although illustrated as having a circular shape, in FIGS. 1, 2 and 4, right side cam 190 and left side cam 192 may take the form of a shaped cam.

A bowstring 280 is provided having one end fixed to right side cams 260 and another end fixed to left side cam 262. Tension in bowstring 210 is typically established by action of limbs 250, 252, 254 and 256 during assembly of crossbow type aimable device 200. This is generally accomplished by applying a compressive force against limbs 250 and 254 and limbs 252 and 256 sufficient to drive the second ends of limbs 250 and 254 and second ends of limbs 252 and 256 toward each other until they reach a first range of relative positions. Limbs 250, 252, 254 and 276 are shaped and made of materials that are elastically deformable within a total range of elastic deformation. Bowstring 280 and lateral support strings 290, and 292 are installed to hold limbs 250, 252, 254, and 256 in the first range of positions that is one part of the total range of elastic deformation.

A lateral support string 290 can be connected to left side pin 272 at one end and to right side cam 190 at the other end, while another lateral support string 292 is connected at one end to right side pin 270 and to left side cam 262 at the other end. Such connections are done so that limbs 250, 252, 254 and 256 will be held within the first range of positions after the compressive force is removed. Thereafter limbs 250, 252, 254, and 256 resist being held in this state and apply a first range of bias forces against bowstring 280.

To ready crossbow type aimable device 200 for use, bowstring 280 is pulled from an initial configuration shown in FIGS. 1 and 2 to a firing configuration (not shown) where bowstring 280 is drawn to a position where it can be held by string capture and fire control system 214. This drawing action causes further elastic deformation of limbs 250, 252, 254 and 256 so that they are within a second range of elastic deformation that is within the total range of elastic deformation. This stores additional energy in the limbs. Once bowstring 280 is drawn fire control system 214 grips bowstring 210 and holds bowstring 280 in the firing configuration against the bias supplied by limbs 250, 252, 254, and 256. When bowstring 280 is securely engaged and controlled by string capture and fire control system 214, the user then loads an arrow onto barrel 220 and positions the arrow such that when string capture and fire control system 214 releases bowstring 280 allowing limbs to return to the first range of elastic deformation. This drives bowstring 280 to urge an arrow generally along barrel 140.

It will be appreciated that stock 20 is not limited for use with an aimable system 200 of the type illustrated here and that stock 20 may be defined for use with other crossbow designs. Additionally, stock 20 may be defined for use with other aimable device 200 including but not limited to devices such as such as the Crosman Airbow which launch arrows using compressed gasses, air guns of the type that use energy from the release of compressed gasses to thrust projectiles along the functional axis, firearms and other devices that use rapidly expanding heated gases to launch projectiles along the functional axis. Similarly, stock 20 may be defined for use with an aimable system 200 having electronic components that generate outputs directed generally with respect to a functional axis non-limiting examples of which include illuminators, lasers, sonic or ultrasonic emitters, that use electro-magnetic or electro-mechanical systems to thrust projectiles from the aimable system laser such as railguns or that have electronic components that sense conditions in an area determined generally by the aimed axis including but not limited to sound waves, visible or non-visible light, LIDAR, RADAR or SONAR reflections, electro-magnetic signals, and vibrations. Examples of projectiles can include but are not limited to medicinal darts, pellets, ball bearings, paintballs, airsoft projectiles, bullets, fluids including but not limited to water based fluids and non-lethal irritants, gels, particulates, sabot type rounds, sound waves, explosives, and smart projectiles such as electronic systems including but not limited to sensors, drones, RFID and IoT enabled devices.

Stock 20 has a body 26 that extends generally along an aiming axis AA. Body 26 is adapted to be mechanically associated with an aimed device 200 so that adjusting aiming axis AA of body 26 changes a functional direction FD of the aimed device 200 in a generally predictable manner. This way, the user can determine the functional direction FD of aimable device 200 by adjusting the orientation of body 26 in space.

In embodiments, body 26 can have a mounting 62 with an interior area 64 having a first side wall 64, a second side wall 66, a rear wall 68 and a base wall 70 within which a frame 216 or other portion of aimable device 200 can be located during use. Body 26 can also provide an opening 72 in base wall 74 through which trigger 212 can pass.

To aid a user in adjusting the aiming axis of stock 20, a plurality of body contact areas are associated with body 26.

In embodiments, such body contact areas can comprise for example a shoulder mount 22, a firing grip 80 and a forestock support 100 each of which can be mechanically associated with body 26 such that the position of these body contact areas determines an orientation of body 26. In certain circumstances, a user may elect to use all three body contact areas For example a user may position shoulder confronting surface 24 against his or her shoulder, grip firing grip 80 by wrapping one hand about firing grip 80 and by grasping forestock support 100 with another hand so that the orientation of body 26 is determined based the relative positions of shoulder mount 22, firing grip 80 and forestock support 100. In other circumstances a user may wish to aim using only firing grip 80 and forestock support 100.

In embodiments, firing grip 80 can comprise a grip surface 82 which can for example and without limitation take the form of a pistol type grip 84 that is positioned. In this arrangement a user can insert an index finger inside a trigger guard 86 to contact a trigger 212 that is connected to string capture and fire control system 214 such that an aimable device 200 can be activated by action of the user's finger against trigger 212. As is shown here, a firing grip 80 can include a trigger guard 86 to help protect against inadvertent contact driving trigger 212 such that aimable device 200 is activated. Other features may be positioned such that they additionally may be actuated or otherwise operated by a user's index finger or other fingers or portions of hand gripping firing grip 80. These may include but are not limited to safety activation or deactivation controls and other controls useful by aimable device 200. In embodiments, firing grip 80 can be integrally formed with body 26, however, in other embodiments, firing grip 80 can, in whole or in part be separately formed Forestock support 100 is shown in FIGS. 1-5 is positioned along the aiming axis AA of body 26 on a side of firing grip 80 that is opposite from shoulder mount 22 and provides a position apart from firing grip 80 from which a user can apply force(s) to determine an orientation of body 26. It will be appreciated that in certain applications including but not limited to a crossbow type aimable device 200 a substantial amount of mass will be positioned forward of firing grip 80 along the aiming axis AA. Forestock support 100 provides a contact point that allows a user to grip and to provide support, and in particular, support against the pull of gravity closer to the center of such mass. This makes it easier for a user of stock 20 in combination with such an aimable device 200 to ensure proper aim during firing.

In embodiments, a support b 110 extends from a mounted end 112 along a length to a foot end 114 with the mounted end 112 joined to body 26 such that foot end 114 is movable relative to body 26.

When positioned as illustrated in FIGS. 1-5, foot end 114 is positioned in a closed position where foot end 114 engages with a receiver 130 that is associated with body 26 such that movement of foot end 114 relative to body 26 is restricted to a first range of positions. In embodiments, foot end 114 has a foot connector 140 and receiver 130 provides a receiver connector 132. Foot connector 140 and receiver connector 132 can be mounted together to hold foot connector and receiver connector within a first range of positions when support leg 110 is in the closed position. In one non-limiting example of this, foot connector 140 is shaped to fit within a space defined by sidewalls 134 so that receiver connector 132 holds foot connector 140 within the first range of positions relative to body 26. The first range of positions generally limits an extent to motion of support leg 110 relative to body 26 such that adjustments of the position of support leg 110 made by a user achieve predictable results during aiming.

For example, receiver connector 132 can be shaped with sidewalls 134 that confine foot connector 140 such that foot connector 140 cannot escape side walls 134 other than when moved along a predetermined direction and by a predetermined distance relative to receiver connector 132. In this example embodiment, the first range of relative motion of foot connector 140 and sidewalls 134 is less than a distance sufficient for foot connector 140 to be moved to escape receiver connector 132. In embodiments, receiver connector 140, foot connector 140 or both can incorporate resilient materials so as to provide a conformal contact between foot connector 140 and sidewalls 134 that allowing a certain degree of relative motion to ensure contact is made between foot connector 140 and sidewalls when foot connector 140 is inserted into receiver connector 132. In embodiments, receiver connector 132, foot connector 140 or both can incorporate resilient materials that provide an extent of vibration or noise dampening. In embodiments, either or both receiver connector 132 and foot connector 140 may be configured to provide frictional resistance to movement that urges separation of receiver connector 132 and foot connector 140.

In embodiments, support leg 110 can be mounted to body 26 at mounting end 112 with receiver connector 132 positioned apart from mounting end by a distance that creates an interference fit between foot connector 140 and a front wall 136 of receiver connector 132. In such an embodiment elastic deformation of any or all of support leg 110, a mounting 116 that joins support leg 110 to body 26, portions of body 26 to which mounting 116 is joined, and foot connector 140, can be used to create a bias force that resist separation of foot connector 140 and receiver connector 132.

As is shown in FIGS. 1, 2, 4 and 5, support leg 110 is defined such that when support leg 110 is in the closed position, a gripping space 120 is defined between base wall 74 and support leg 110 that is sized such that a user can grip support leg 110 with an oppositional grip to constrain movement of the body and aimed device along an axis such as axis 122 that is not parallel to aiming axis AA. This also allows a user to manually resist the effects of gravity, recoil and other forces created during use of aimable device 200.

Figure 6:
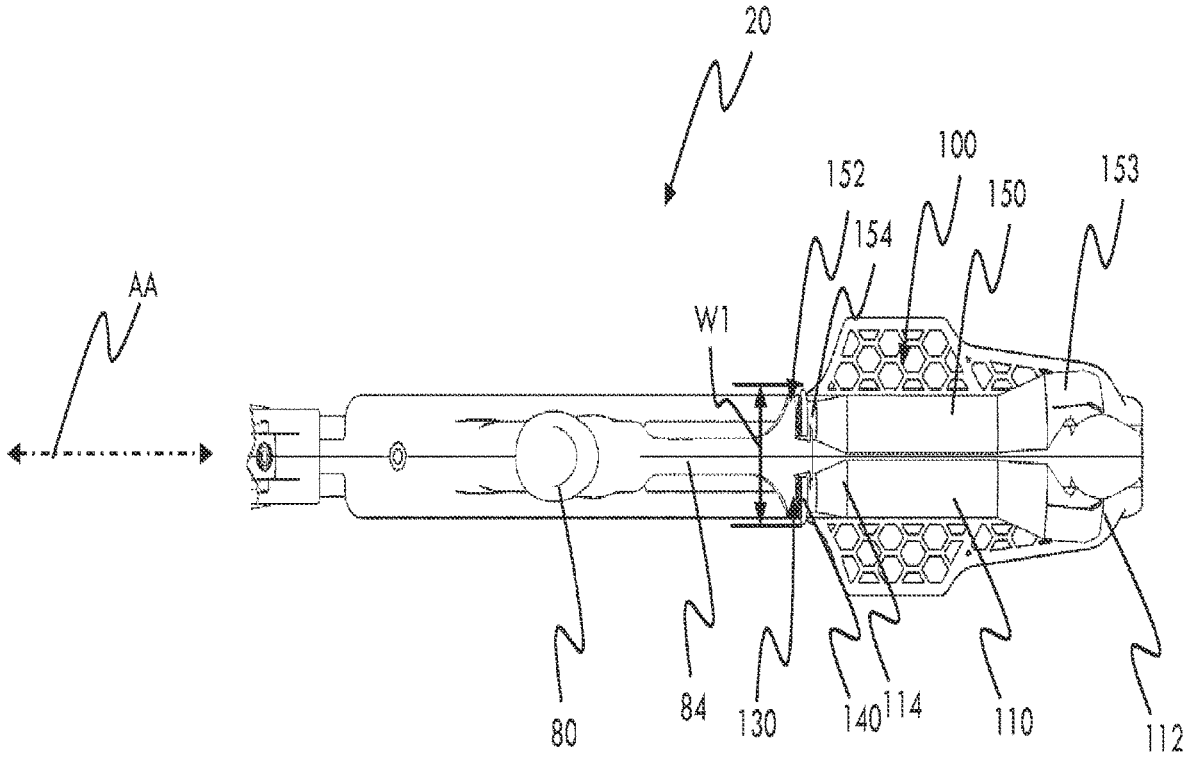
FIG. 6 shows a bottom view of the embodiment of FIG. 1.

As is also shown in FIGS. 1, 2, 4, 5 and 6 body 26 may use at least one additional support leg 150 may be used with at least one additional receiver 152 with the principles of operation of the at least one additional support leg 150, having as shown in FIGS. 1, 4, and 6 a mounting end 153, a foot end 154 the at least one additional receiver 152 being based upon embodiments described herein. In non-limiting embodiments, the at least one additional support leg 150 and the at least one additional receiver 152 may be positioned adjacent to and on opposite sides of an aiming axis AA of a stock 20 and, where useful, such embodiments operate in a reverse or mirror like fashion relative to a lengthwise cross section taken along aiming axis AA. In such embodiments, support leg 110 and the at least one additional support leg 110 may cooperatively define a forestock support 100 that can be gripped by a user.

Figure 7:
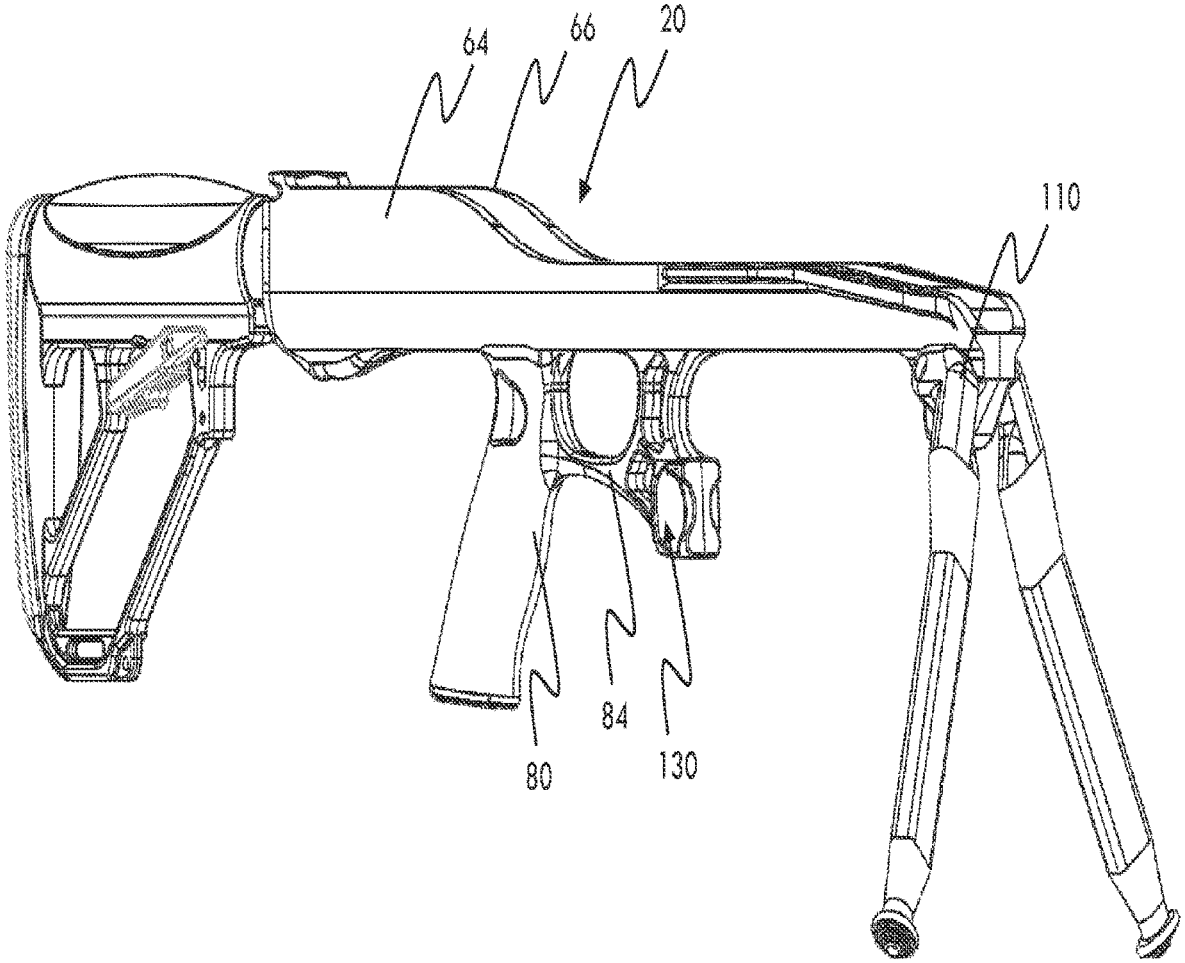
FIG. 7 shows a right front perspective view of a stock in an open support configuration.
Figure 8:
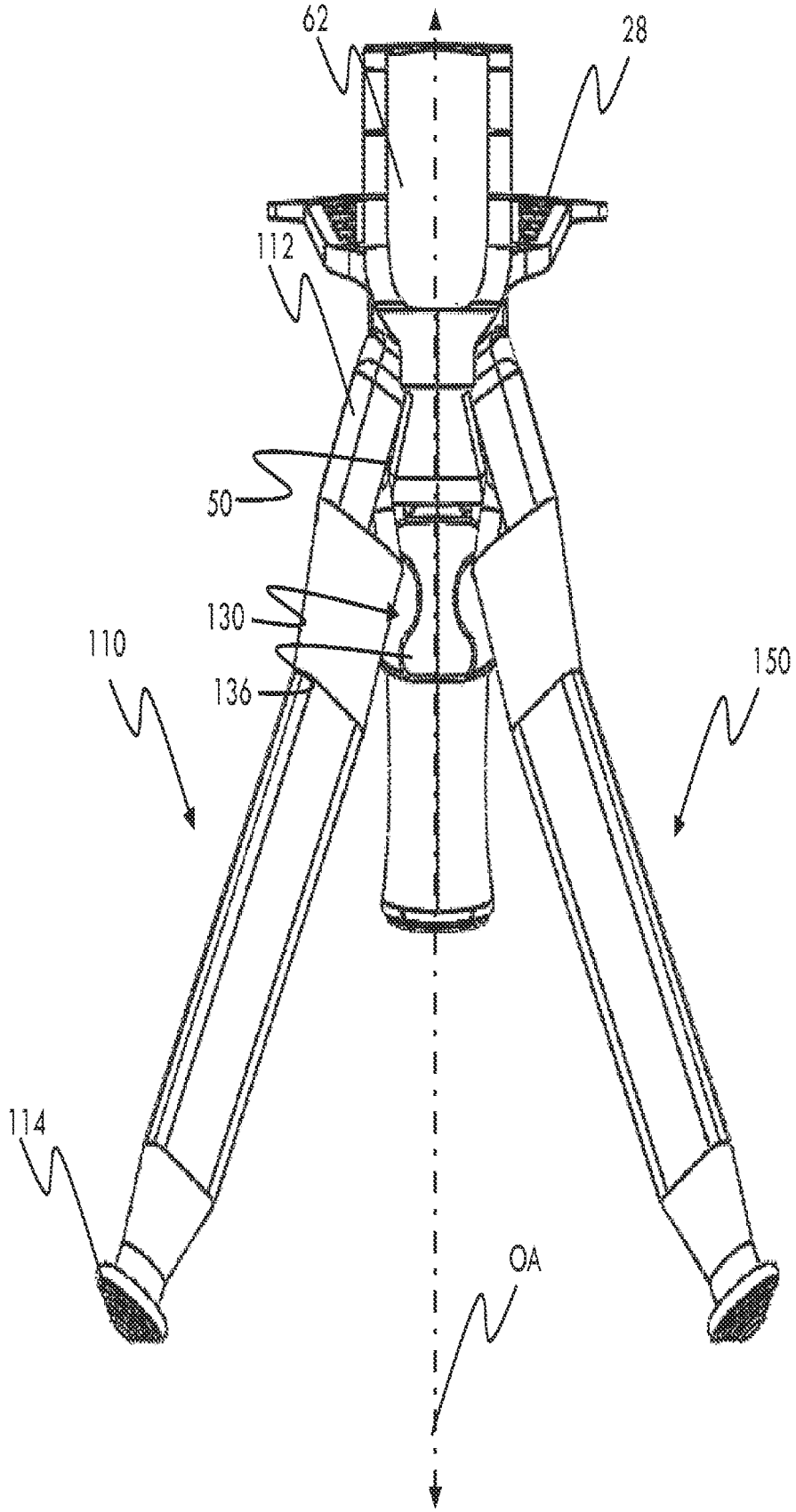
FIG. 8 shows a front view of the stock of the embodiment of FIG. 1.
Figure 9:
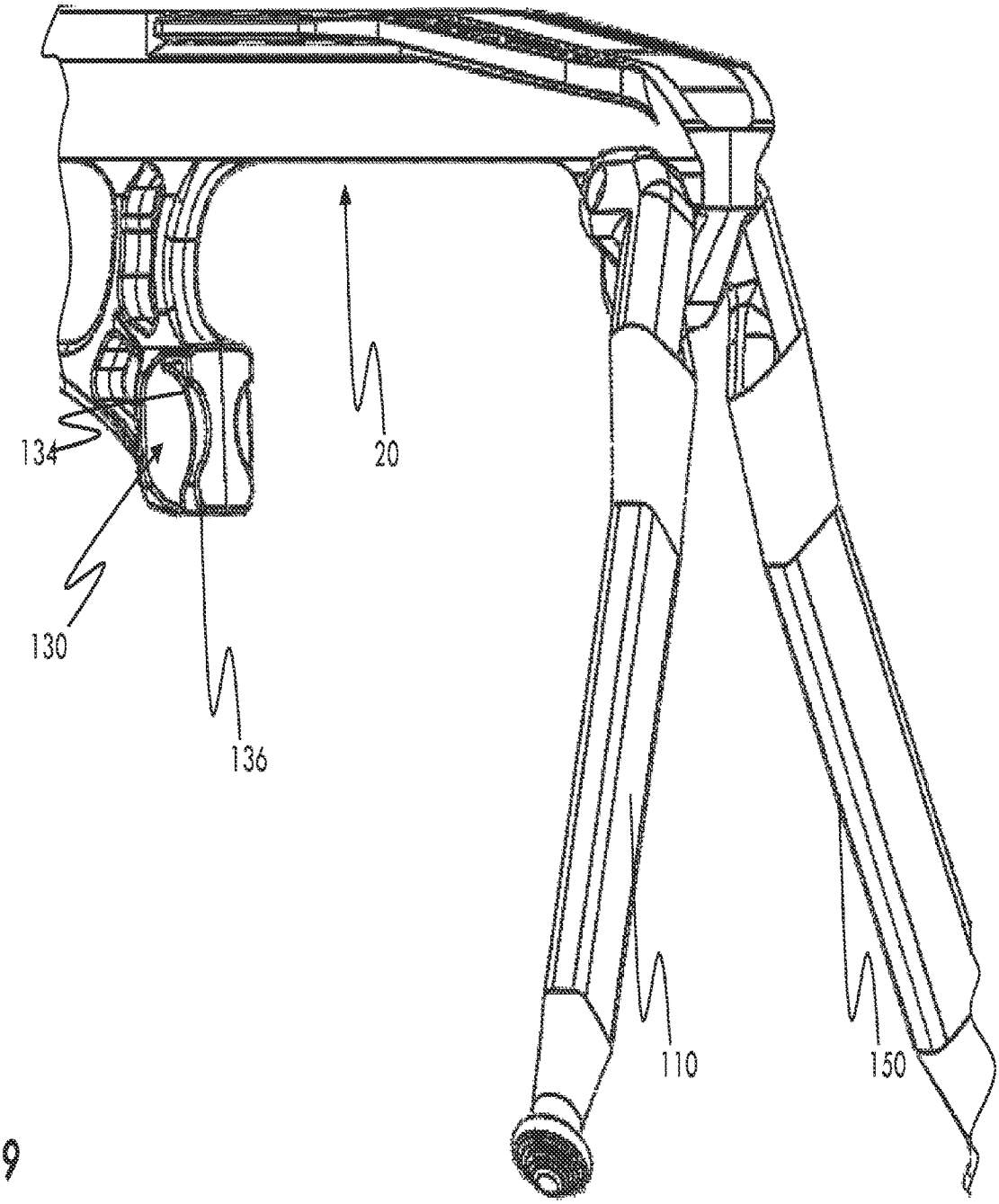
FIG. 9 shows an enlarged front right side view of a portion of the stock in the open support configuration.
Figure 10:
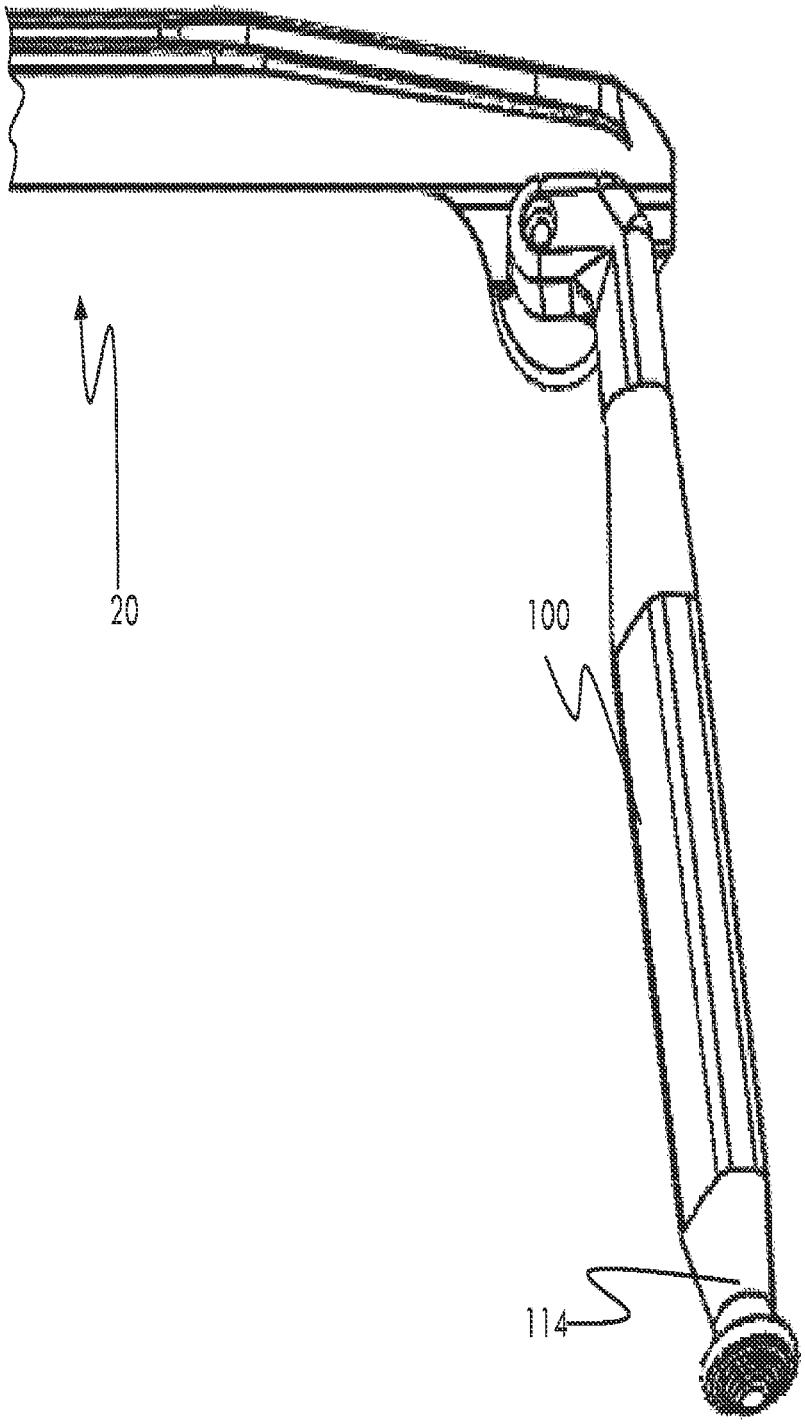
FIG. 10 shows a right side view of stock in an open support configuration.

FIG. 7 shows a right front perspective view of a stock 20 in an open support configuration. FIG. 8 shows a front elevation of stock 20, FIG. 9 shows an enlarged front right side perspective view of a portion of stock 20 in the open support configuration, and FIG. 10 shows a right side elevation view of stock 20 in an open support configuration. As is shown in FIGS. 6-10 support leg 110 and, optionally, at least one additional support leg 150 can be positioned beyond the first range of positions with foot connector 140 positioned such that support leg 110 is arranged apart from receiver 130 so that support leg 110 provides support to body 26 by way of mounting end 112. This allows support leg 110 to provide support to a forward portion of body 26 along an axis not parallel to an axis of aiming AA without necessarily requiring manual contact with support leg 110.

For example as is shown in FIGS. 6-10, support leg 110 and optional additional support leg 150 can be used to provide a bi-pod that can directly support body 28 and any aimable device (not shown) associated therewith so as to enable aiming and activating stock 20 and such aimable device without manually supporting at the forestock positioner 100. The advantages of aiming and using an aimable device with such a support are well known and include but are not limited to increased stability and reduced operational fatigue.

It will be appreciated that support leg 110 extends for a length that is at least twice as long as it is wide accordingly support leg 110 has greater strength when used to manage a compression load than when used to receive a beam load. However, structures designed to provide significant beam strength and compression loading can be complex to design and manufacture where it is also required that such structures be light weight. In embodiments, stock 20 allows for less complex and lighter weight design of support legs 110 by enabling the use of a structure that is primarily shaped to provide compression support such that support leg 110 can independently support a front end of stock 20 in compression when in the open position while still allowing for significant beam strength through the use of two ends of support when in the closed position. It will also be appreciated that in embodiments, recoil energy from firearms, crossbows or other types of aimable devices 200 can be managed in part by channeling a portion of such energy through support leg 110 which can provide stiffening or dampening effects in embodiments.

Figure 11:
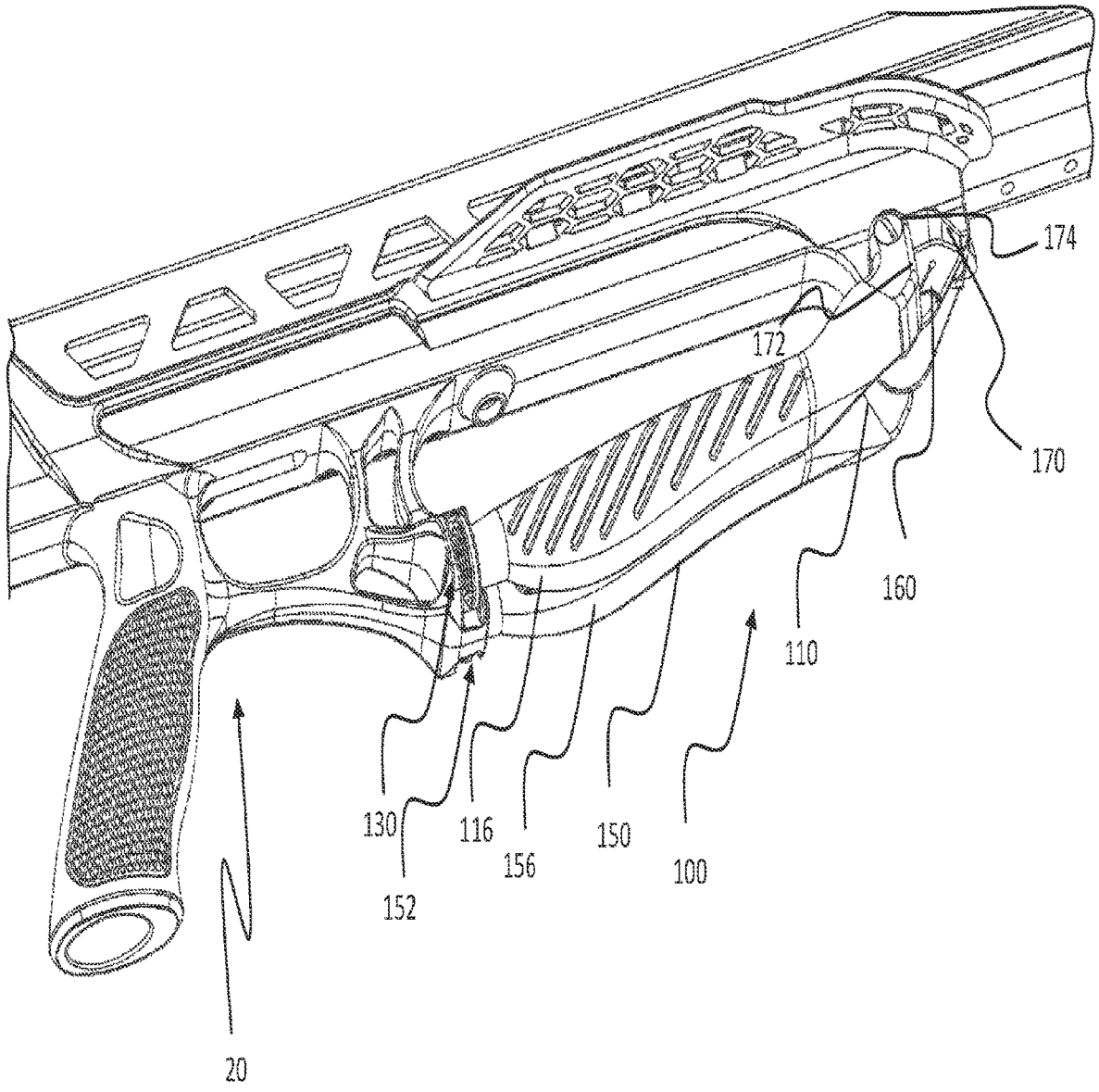
FIG. 11 shows a right side, bottom back view of another embodiment of stock.
Figure 12:
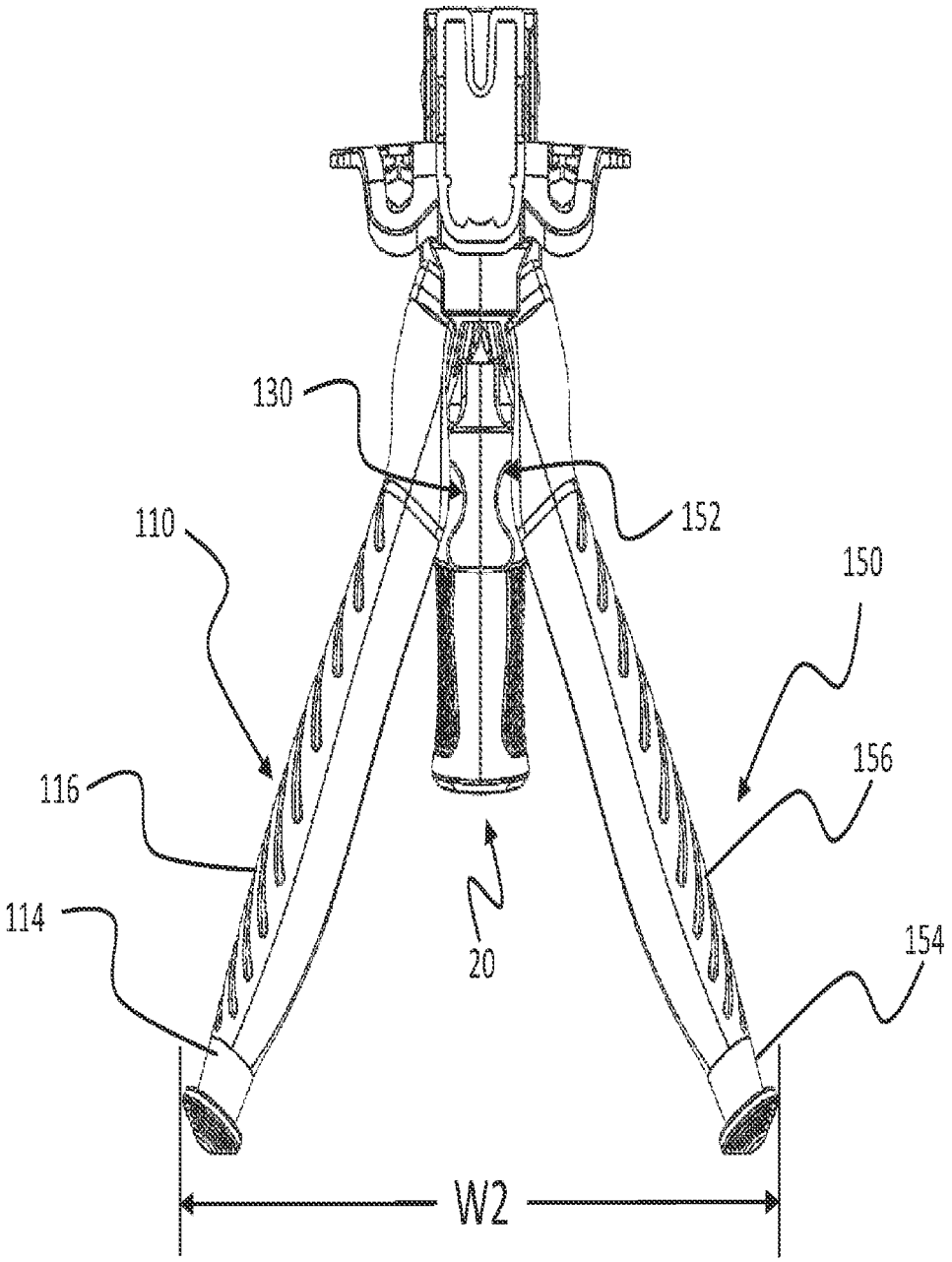
FIG. 12 shows a front view of optional features of an embodiment of stock.

FIG. 11 shows a left side, bottom back view of another embodiment of stock 20 and FIG. 12 illustrates a front view of optional features of an embodiment of stock 20. Here first support leg 110 and optional second support leg 150 are shown with external surfaces 116 and 156 respectively that are ergonomically shaped, in combination, for gripping by a hand. In this embodiment, such ergonomic features include palm swell configuration and surface texture features for extra purchase. Additionally, as is shown in FIGS. 11 and 12, a bearing surface 160 is provided proximate to mounting end that is shaped with a slit or relief to allow a certain portion of bearing surface 160 to deform or flex when support leg 110 is between two predetermined configurations so as to apply a bias urges support leg 110 into one of the predetermined configurations. Also shown in this embodiment, a stop 172 is formed to engage a forward surface 174 of support leg 110 to receive force directly from forward surface 174 when support leg 110 is in the open position to reduce the amount of force that a mounting 178 must directly convey to body 26.

As is further illustrated in FIGS. 5 and 12, in embodiments, first foot end 114 and second foot end 154 can be within a first width W1 when the first foot end and the second foot end are in a first range of positions as for example shown in FIG. 5 while the first foot end and second foot end are within a second width when the first foot end and the second foot end are in the second range of positions as for example shown in FIG. 12. As can be observed herein, the first width W1 is smaller than the second width W2. As can also be observed in FIGS. 5 and 12, first foot end 114 moves apart from the body 26 in a first direction along a width as the first foot end is moved from the first range of positions toward the second range of positions. However, second foot end 154 moves apart from the body 26 in a second direction along the width as the second foot end is moved from the first range of positions to the second range of positions.

While the invention has been particularly shown and described with reference to a preferred embodiment thereof, it will be understood by those skilled in the art that various other changes in the form and details may be made therein without departing from the spirit and scope of the invention. For example and without limitation, in embodiments, any support leg may be extendable or contractable.

What is claimed is:

1. A stock for use with an aimable device, the stock comprising:

a body;

a firing grip;

a support leg including a first end pivotably mounted to the body between (i) the firing grip and (ii) a second end of the body opposite a third end of the body, the support leg further including a fourth end movable relative to the body between positions of a plurality of positions; and a receiver located between the first end of the support leg and the firing grip, wherein the receiver is configured to releasably hold the support leg in first positions of the plurality of positions, and wherein the support leg is configured to provide a grippable forestock when the support leg is in the first positions of the plurality of positions.

2. The stock of claim 1, wherein:

the receiver comprises sidewalls;

the first end of the support leg is configured for use as a surface contact when the support leg is in second positions of the plurality of positions; and the first end of the support leg is configured to fit within a space defined by the sidewalls of the receiver.

3. The stock of claim 2, wherein the sidewalls of the receiver are configured to confine a first connector such that the first end of the support leg is movable beyond the sidewalls of the receiver only when moved (i) in a predetermined direction relative to a second connector and (ii) a predetermined distance relative to the second connector.

4. The stock of claim 3, wherein the receiver and the first end of the support leg comprise resilient materials that provide conformal contact between the first end of the support leg and the sidewalls of the receiver that allow a degree of relative motion when the first connector is moved into the second connector.

5. The stock of claim 1, wherein at least one of (i) the receiver or (ii) the support leg comprise resilient materials configured to dampen at least one of vibration or noise.

6. The stock of claim 1, further comprising:

a mounting between the support leg and the body, wherein a connector is positioned apart from the mounting by a distance that creates an interference fit between the first end of the support leg and a front wall of the receiver, and wherein at least one of (i) the support leg, (ii) the body, or (iii) the receiver elastically deforms to provide a bias force that resists separation of the first end of the support leg and the receiver.

7. The stock of claim 1, wherein a portion of the body between the support leg is configured for a user to at least in part wrap fingers around the support leg.

8. The stock of claim 1, further comprising at least one biasing feature configured to bias the support leg into second positions of the plurality of positions.

9. The stock of claim 8, wherein the at least one biasing feature comprises a bearing surface proximate the support leg.

10. A stock for use with an aimable device comprising:

a body;

a firing grip coupled to the body;

a first support leg pivotably coupled to the body; and a second support pivotably coupled to the body, wherein the first support leg and second support leg define a first width providing a grippable forestock when arranged in a closed position, and wherein the first support leg and the second support leg define a second width greater than the first width when arranged in an open position.

11. The stock of claim 10, wherein the first support leg and the second support leg are positioned adjacent to each other when arranged in the closed position.

12. The stock of claim 10, wherein the body defines a body width and the first width is less than the body width.

13. The stock of claim 10, wherein the second width is at least two times greater than the first width.

14. The stock of claim 10, further comprising biasing members that bias the first support leg and the second support leg toward the open position.

15. The stock of claim 10, wherein the open position provides a bipod.

16. A stock, comprising:

a body defining a projectile axis;

a grip extending from the body; and a support leg pivotably coupled to the body about a support leg axis arranged oblique to the projectile axis, the support leg pivotable about the support leg axis between a closed grippable forestock position and an open support position.

17. The stock of claim 16, further comprising a receiver configured to releasably hold the support leg in the closed grippable forestock position.

18. The stock of claim 17, wherein the receiver includes sidewalls defining a space sized to receive the support leg with an interference fit.

19. The stock of claim 17, further comprising a resilient material positioned between the receiver and the support leg.

20. The stock of claim 16, further comprising a biasing feature configured to bias the support leg into the open support position.

* * * * *